US007004505B2

(12) United States Patent
Perelman

(10) Patent No.: US 7,004,505 B2
(45) Date of Patent: Feb. 28, 2006

(54) CALENDAR

(76) Inventor: Brad S. Perelman, 5815 Northumberland St., Pittsburgh, PA (US) 15217

( * ) Notice: Subject to any disclaimer, the term of this patent is extended or adjusted under 35 U.S.C. 154(b) by 0 days.

(21) Appl. No.: 10/462,171

(22) Filed: Jun. 16, 2003

(65) Prior Publication Data

US 2003/0230890 A1 Dec. 18, 2003

Related U.S. Application Data

(60) Provisional application No. 60/389,247, filed on Jun. 17, 2002.

(51) Int. Cl.
*B42D 5/04* (2006.01)

(52) U.S. Cl. ..... 283/2; 40/107; 40/110; 40/118; 40/119; 283/114; D19/20; D19/24; D19/25; 368/28

(58) Field of Classification Search ..... 283/2, 283/114; 40/107, 110, 118, 119; D19/20, D19/24, 25; 368/28
See application file for complete search history.

(56) References Cited

U.S. PATENT DOCUMENTS

| | | | | | |
|---|---|---|---|---|---|
| 369,945 | A * | 9/1887 | Jayne | 283/2 |
| 442,337 | A * | 12/1890 | Ryer | 283/2 |
| 3,838,530 | A * | 10/1974 | Schelling, Jr. | 40/107 |
| 4,226,443 | A * | 10/1980 | Brown | 283/2 |
| 6,064,975 | A * | 5/2000 | Moon et al. | 705/8 |
| 6,266,295 | B1 * | 7/2001 | Parker et al. | 368/28 |

* cited by examiner

*Primary Examiner*—Boyer Ashley
*Assistant Examiner*—Mark Henderson
(74) *Attorney, Agent, or Firm*—The Webb Law Firm

(57) ABSTRACT

A calendar comprising a medium upon which a plurality of indicia are applied, wherein each of the indicia coacts with an adjacent indicia, and wherein each of the indicia is visually indicative of a complete lunar day and a complete solar day. Each indicia for the lunar day coacts with two indicia for the solar day and each indicia for the solar day coacts with two indicia for the lunar day. Additionally, the calendar comprises an interlocking notched indicia weekday banner, wherein the interlocking notched indicia weekday banner represents the relation between the seven days of a Jewish week and the seven days of a secular week. Furthermore, each indicia may form a plurality of indicia identifying a respective plurality of days, a respective one or more weeks, a respective one or more months, or a respective one or more years.

17 Claims, 3 Drawing Sheets

CALENDAR

CROSS REFERENCE TO RELATED APPLICATIONS

This application claims the benefit of U.S. Provisional Patent Application No. 60/389,247, filed Jun. 17, 2002, and entitled "Calendar", the contents of which are hereby incorporated herein by reference.

BACKGROUND OF THE INVENTION

1. Field of the Invention

The present invention relates to calendars and, more specifically, to a calendar that corresponds a Jewish calendar to a Gregorian calendar.

2. Description of Related Art

Generally speaking, the calendar of the Western civilization is a Gregorian calendar which is solar-based, having approximately 365.25 calendar days each year. It begins on January 1$^{st}$ and ends on December 31$^{st}$, with each Gregorian calendar day stretching from midnight to midnight.

The Jewish calendar was inaugurated over three-thousand years ago upon G-d's commandment to the Jews in Egypt to proclaim the holiness of the month of Nissan. Since that first commandment and first collective act of Jewish nationhood, the lunar-based calendar, with Rabbinically calculated seasonal adjustments, has guided the Jews throughout history. During the times of the First and Second Temples, the Sanhedrin (i.e., The Great Assembly), certified witnesses of the New Moon, sanctified the New Month (i.e., Rosh Chodesh), and announced it through a system of hilltop fires and messengers. This procedure remained in force until the fourth century C.E., when Hillel II fixed all the future Jewish months and years.

This order of the Hebrew Monthly continues to be universally accepted in Israel and in the Diaspora.

In addition to the Jewish calendar being lunar-based, with each month beginning on the appearance of a new moon, the Jewish day stretches from sunset to sunset. Thus, a strictly Jewish calendar begins at sunset on the first day of the month of Tishrei, i.e., the Jewish New Year, Rosh Hashanah.

Yet typically, prior art contemporary Jewish calendars are formatted according to the secular/solar year, thus prior art contemporary Jewish calendars begin on the secular date of September 1 instead of on the Jewish day of Tishrei 1. This results in the calendar displaying complete secular months instead of complete Jewish months.

Furthermore, the visual indicia used to indicate days in prior art Jewish calendars represents the secular day stretching from midnight to midnight, as opposed to the Jewish day stretching from sunset to sunset.

What is needed and has not heretofore been developed is a calendar that visually integrates the Gregorian solar-based calendar, including months and daily structure, within a Jewish lunar-based calendar with its unique month and day structure. Accordingly, it is an object of the present invention to provide a lunar calendar and Gregorian solar-based calendar that is easier to use than the prior art calendars.

BRIEF SUMMARY OF THE INVENTION

The present invention is a calendar that visually integrates a solar-based calendar, such as a Gregorian calendar, including a month and daily structure, within a lunar-based calendar, such as a Jewish calendar. More specifically, the present invention allows a user to view his or her daily life in relation to Jewish dates. Preferably, the calendar includes at least one Jewish calendar month that incorporates a corresponding Gregorian calendar month through visual indicia. The visual indicia include an interlocking notched weekday banner, which includes the seven days of the Jewish week and how the days relate to the seven days of the secular week. The visual indicia further include two or more day blocks, wherein each day block has at least two other visual indicia, or portions. The portions may be quadrilaterals, or more specifically, rectangles. One portion of the day block represents a Gregorian calendar day and the other portion of the day block represents a Jewish calendar day. The portions are situated in an offset relation to each other, thereby forming an offset between the two portions. The two portions are visually indicative of a complete lunar day and a complete solar day. All additional day blocks in the calendar month have a similar notched arrangement, or recesses on each side, thus allowing all day blocks to be interlocked or mated with each other by means of the offset. In effect, the portion designating the lunar day coacts with two adjacent portions designating solar days. Similarly, the portion designating the solar day coacts with two adjacent portions designating lunar days. Thus, in relation to the interlocking notched weekday banner, the offset of each day block represents a part of the Jewish calendar day, which occurs between sunset and midnight of the Gregorian calendar day.

The calendar also illustrates which of the Gregorian calendar days on the Gregorian calendar month are encompassed by Jewish calendar days. Furthermore, the calendar provides a list of the Sabbath candle-lighting times and unique artwork that corresponds to individual months of the calendar. Additionally, the calendar includes one or more of the following markings: a Jewish month in a first language, such as English; a secular day in the first language; a Jewish year in the first language; a Jewish year in a second language, such as Hebrew; a Jewish day in the second language; a Jewish holiday in the first language; a Jewish holiday in the second language; a candle lighting; a Torah passage; a Torah reading for the Sabbath holidays; and a moon phase. The calendar may exhibit various time structures, including, but not limited to, one or more weeks, one or more months, and one or more years. It is to be understood that the calendar may be embodied in a variety of mediums, such as print media (e.g., paper) and electronic media (e.g., personal digital assistants).

In an alternate embodiment of the present invention, other types of indicia, such as different shadings, configurations, or geometric shapes having a perimeter, can be provided so that the user can identify the corresponding Jewish calendar day and Gregorian calendar day quickly and efficiently. Additionally, the visual indicia of the Jewish calendar month may be orientated to read from left to right, as opposed to right to left. In another alternate embodiment, the present invention can also be used to correspond other types of calendars with one another.

These and other advantages of the present invention will be understood from the description of the preferred embodiments, taken with the accompanying drawings, wherein like reference numerals represent like elements throughout.

DETAILED DESCRIPTION OF THE INVENTION

Figure 1:
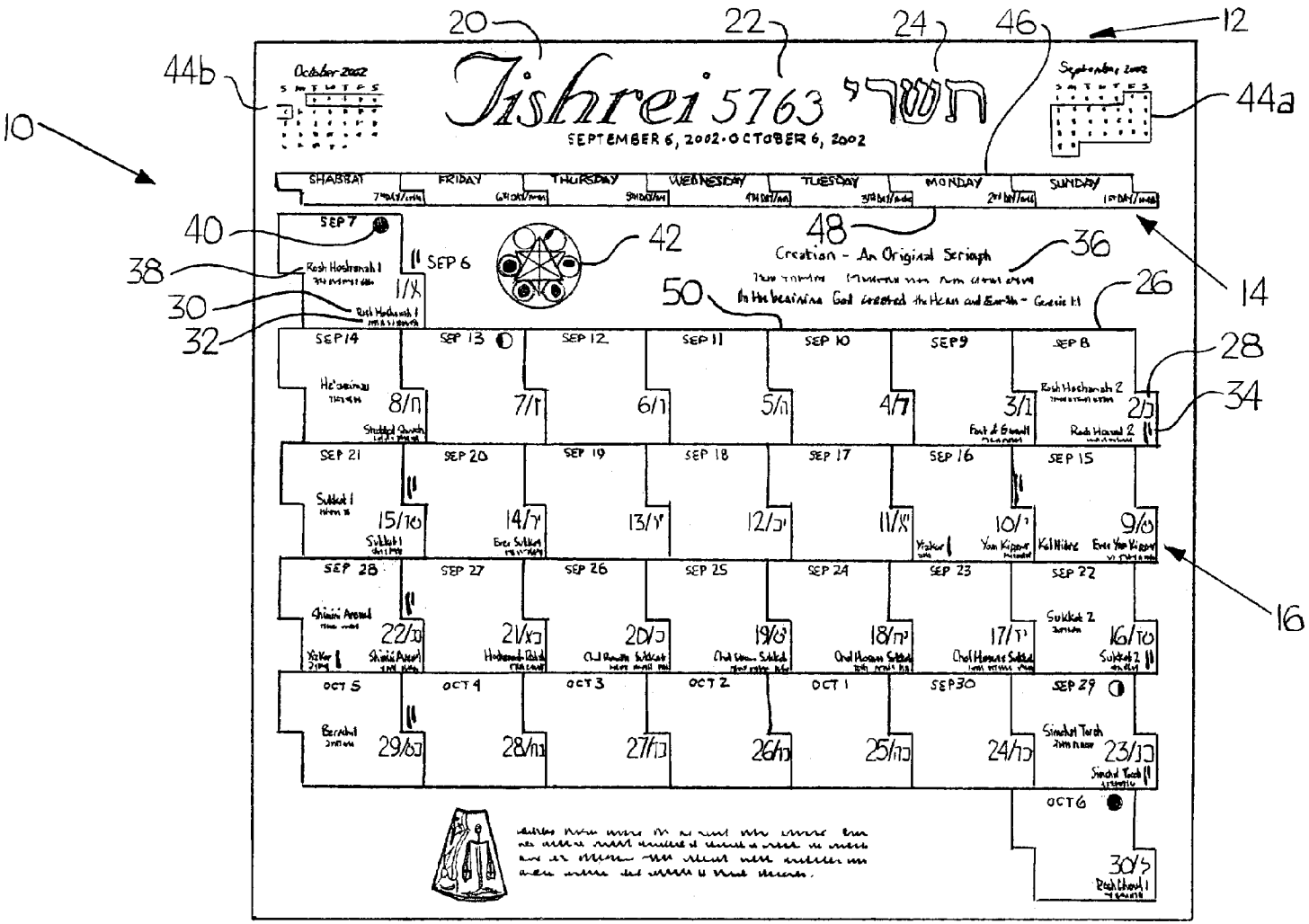
FIG. 1 shows a Jewish calendar month according to a preferred embodiment of the present invention.

For purposes of the description hereinafter, the terms "top", "bottom", "left", and "right", and derivatives thereof, shall relate to the invention as it is oriented in the drawing figures. However, it is to be understood that the invention may assume various alternative variations, except where expressly specified to the contrary.

The present invention is a Jewish calendar that integrates the secular/solar day, month, and year, within the Jewish/lunar structure. The Jewish calendar includes at least one Jewish calendar month 10, as illustrated in FIG. 1, yet it should be understood that the Jewish calendar can include a daily, weekly, or yearly format. Referring to FIG. 1, the Jewish calendar month 10, according to the present invention, primarily includes a month title 12, an interlocking notched weekday banner 14, and an interlocking notched day block arrangement 16. Additionally, the Jewish calendar month 10 may also include the following markings: a Jewish month in English 20; a Jewish year in English 22; a Jewish month in Hebrew 24; a secular weekday in English 26; a Jewish weekday in Hebrew 28; a Jewish holiday in English 30, a Jewish holiday in Hebrew 32, a candle lighting 34; a Torah passage (Five Books of Moses) 36; a Torah reading 38 for Sabbath holidays; and a moon phase 40. It is to be understood that descriptions in other languages can be substituted for English language descriptions. Furthermore, the Jewish calendar 10 may also include at least one artwork 42 that may be unique to the Jewish calendar month 10. The Jewish calendar month 10 may also include one or more perspective months 44*a*, 44*b*, indicating which Gregorian calendar days on the Gregorian calendar month are encompassed by Jewish calendar days.

Figure 2:
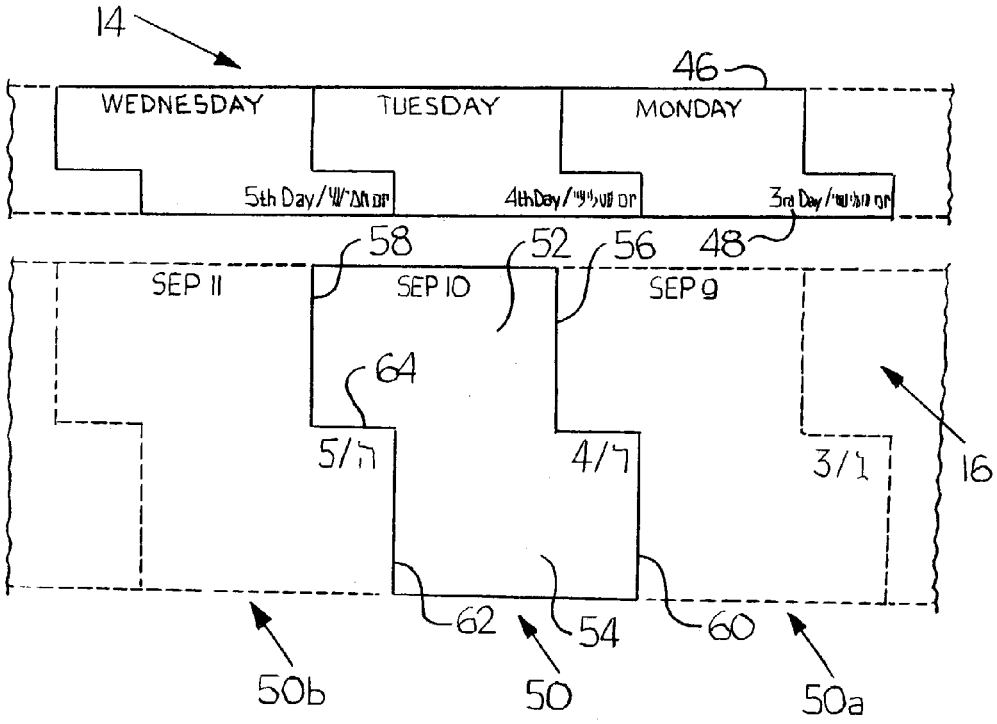
FIG. 2 shows a partial view of an interlocking notched day block arrangement representing a plurality of days from the Jewish calendar month depicted in FIG. 1.

With continuing reference to FIG. 1, FIG. 2 shows a partial view of the interlocking notched day block arrangement 16 representing a plurality of calendar days in relation to the interlocking notched weekday banner 14. In the preferred embodiment, it is to be understood that the Jewish calendar month 10 functions in a right-to-left orientation. The interlocking notched weekday banner 14 includes a top weekday portion 46 and a bottom weekday portion 48. The top weekday portion 46 designates the secular weekday, or Gregorian weekday, whereas the bottom weekday portion 48 designates the Jewish weekday. Thus, the interlocking notched weekday banner 14 depicts the seven days of the Jewish week in relation to the seven days of the secular week.

Each day is represented as a day block 50 in the interlocking notched day block arrangement 16 in the Jewish calendar month 10. Each day block 50 includes one or more visually distinct or indistinct portions (i.e., portions which are seamless or unbounded on one or more sides). Preferably, the day block 50 includes two portions, a top day portion 52 and a bottom day portion 54, positioned on top of each other and forming an offset relation with each other. The top day portion 52 designates the secular, or Gregorian calendar day, whereas the bottom day portion 54 designates the Jewish calendar day. The top day portion 52 and the bottom day portion 54 each have two distal ends. In the preferred embodiment, the distal ends are represented as leading and trailing edges. An upper trailing edge 56 of the day block 50 signifies the beginning of a Gregorian calendar day, i.e., midnight, and an upper leading edge 58 of the day block 50 signifies the end of a Gregorian calendar day, i.e., midnight. A lower trailing edge 60 signifies the beginning of the Jewish calendar day, i.e., sunset, and a lower leading edge 62 signifies the end of the Jewish calendar day, i.e., sunset. The offset relation of the top day portion 52 and the bottom day portion 54 of the day block 50 allows each day block 50 to be interlocked with another adjacent day block, either to the left and/or to the right of the day block 50. Accordingly, this offset relation forms an offset 64 between the lower leading edge 62 and the upper leading edge 58. This offset 64 represents a segment of a day when the Jewish calendar day and the Gregorian calendar day overlap, i.e., that part of a new Jewish calendar day that occurs between sunset and midnight of any Gregorian calendar day. By utilizing the interlocking notched weekday banner 14, a user may determine the weekday that corresponds to the current Gregorian or Jewish calendar day.

For example, with reference to FIGS. 1 and 2, the Jewish month in English 20 is Tishrei, with the Jewish year in English 22 depicted as 5763. The top weekday portion 46 of the interlocking notched weekday banner 14 lists each secular weekday in English 26, including Sabbath (Saturday), Sunday, Monday, Tuesday, Wednesday, Thursday, and Friday. The bottom weekday portion 48 of the interlocking notched weekday banner 14 lists each Jewish weekday. An example of the Jewish Holiday in English 30 is Rosh Hashanah. The Torah passage 36 cites Genesis 1:1. Rosh Hashanah I is designated as the Torah reading 38. The moon phase 40 indicates the beginning of a lunar cycle. Unique artwork 42 is designated to symbolize the Jewish calendar month 10 of Tishrei. To the left and right of the month title 12 is a right perspective month 44*a* and a left perspective month 44*b*, shown as an October 2002 and a September 2002 calendar month, respectively. The first day of Tishrei coincides with September $6^{th}$ of the Gregorian calendar month and the last day of Tishrei coincides with October $6^{th}$ of the Gregorian calendar month. Therefore, in order to show which Gregorian calendar days are encompassed by Jewish calendar days, the right perspective month 44*a* has September $6^{th}$ through September $30^{th}$ highlighted and the left perspective month 44*b* has October $1^{st}$ through October $6^{th}$ highlighted.

With continuing reference to FIG. 1, FIG. 2 shows a partial view of the interlocking notched day block arrangement 16. Gregorian calendar days September $9^{th}$, $10^{th}$, and $11^{th}$, corresponding to the $3^{rd}$, $4^{th}$, and $5^{th}$ Jewish calendar days of Tishrei, are represented as day blocks 50*a*, 50, and 50*b*, respectively. The top day portion 52 of day block 50 designates September $10^{th}$, whereas the bottom day portion 54 of day block 50 designates the $4^{th}$ day of Tishrei. The upper trailing edge 56 of the day block 50 signifies the end of September $9^{th}$ and the beginning of September $10^{th}$ The upper leading edge 58 of the day block 50 signifies the end of September $10^{th}$ and the beginning of September $11^{th}$. The lower trailing edge 60 signifies the end of the $3^{rd}$ day of Tishrei and the beginning of the $4^{th}$ day of Tishrei. The lower leading edge 62 signifies the end of the $4^{th}$ day of Tishrei and the beginning of the $5^{th}$ day of Tishrei. The offset relation of the top day portion 52 and the bottom day portion 54 allows the preceding day block 50*a* to be interlocked with day block 50 and allows the following day block 50*b* to be interlocked with day block 50. Thus, the September $10^{th}$ day block 50 is interlocked between the September $9^{th}$ preceding day block 50*a* and the September $11^{th}$ following day block 50*b*. The offset 64 represents the portion of September $10^{th}$ that overlaps the $5^{th}$ day of Tishrei of day block 50*b*. Specifically, the offset 64 visually identifies the time between sunset and midnight on September $10^{th}$. The weekdays, Monday, Tuesday, and Wednesday, of the interlocking notched weekday banner 14 correspond with day blocks 50*a*, 50, and 50*b*, respectively. Therefore, in the context of the interlocking notched weekday banner 14, the offset 64 also represents the part of Tuesday in the Gregorian calendar day that overlaps the part of Wednesday (i.e., the fifth day) in the Jewish calendar day.

Figure 3:
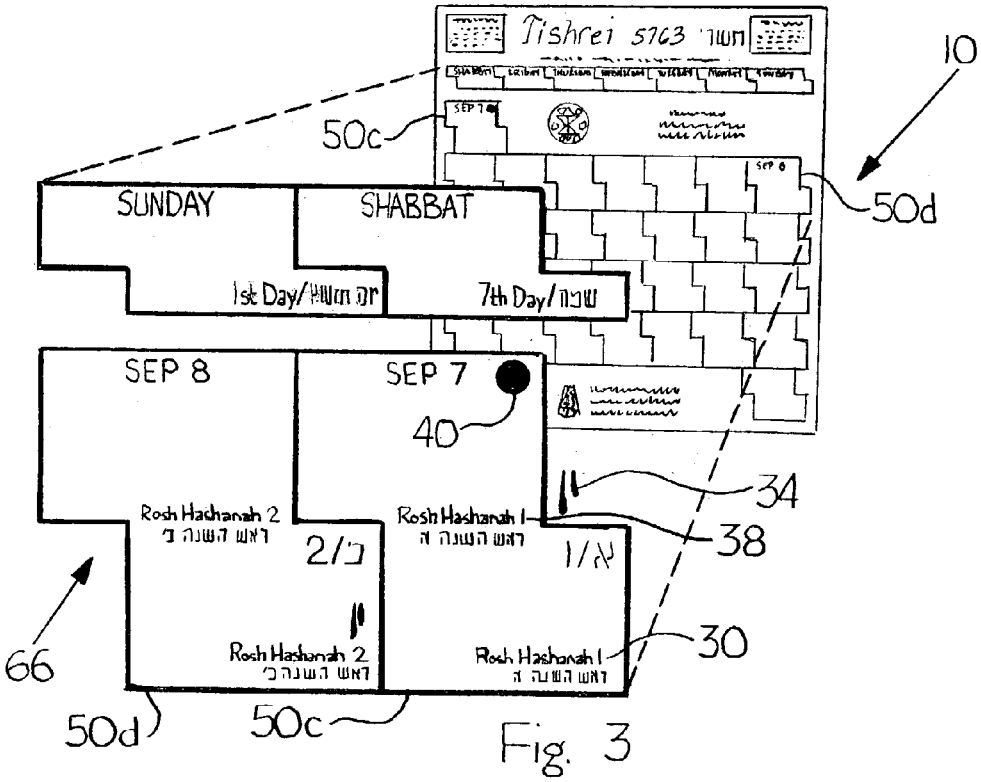
FIG. 3 shows an exploded view of two interlocked day blocks comprising days on opposite sides of the Jewish calendar month depicted in FIG. 1.

FIG. 3 shows an exploded view 66 of interlocked Sabbath (Saturday) and Sunday day blocks, 50*c* and 50*d*, respectively. Day blocks 50*c* and 50*d* are unique from other day blocks only to the extent that they include days on opposite sides of the Jewish calendar month 10. As with any of the Sabbath and Sunday day blocks, such day blocks are not visually interlocked. Therefore, in order to appreciate the overlap between the Gregorian calendar day and the Jewish calendar day, the user must invoke a mental image of an interlocked arrangement for the two day blocks, 50*c* and 50*d*, as depicted in FIG. 3.

Figure 4:
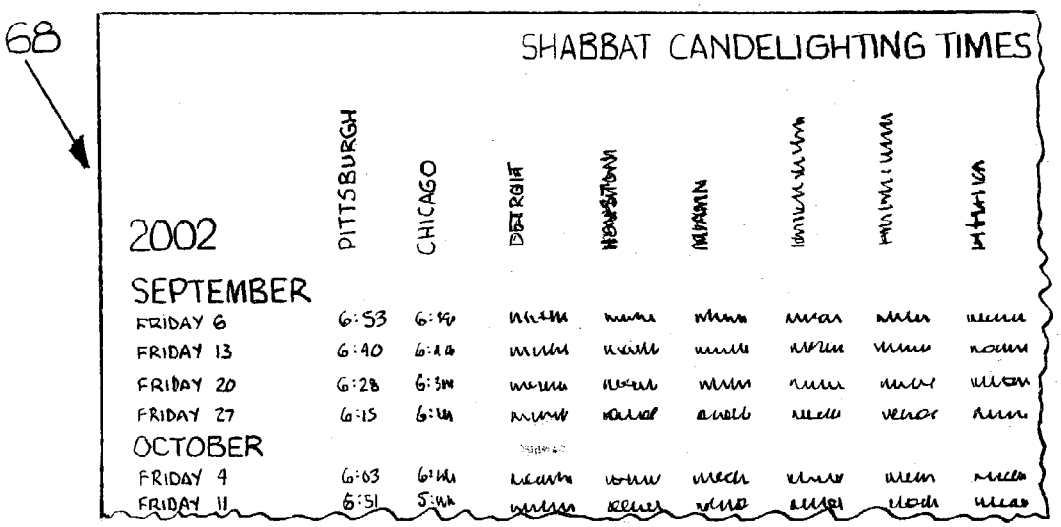
FIG. 4 shows a Sabbath candle-lighting times schedule.

The exploded view 66 in FIG. 3 is illustrative of markings used in the Jewish calendar month 10. For example, the Jewish Holiday in English 30 is Rosh Hashanah. Rosh Hashanah occurs during Sabbath, the $1^{st}$ day of Tishrei. In terms of the Gregorian calendar month, Rosh Hashanah begins on September $6^{th}$ at sunset and ends on September $8^{th}$ at sunset. It is to be understood that for Orthodox Jews, Rosh Hashanah spans two days and thus, a second day entitled Rosh Hashana 2 is depicted in the Jewish calendar month 10. The Sabbath and certain other Jewish holidays, as is the case with Rosh Hashanah, have candle-lighting requirements. The candle-lighting marking 34 indicates the days candles are to be lit. The calendar may also include a Sabbath Candle-Lighting Times schedule 68, as shown in FIG. 4. The Sabbath Candle-Lighting Times schedule 68 outlines, according to the geographic location of the user, the specific time of the day a user is to light the candles. For example, if a user's location is Pittsburgh, Pa., USA, then the user is to light Sabbath candles at 7:26 PM on Friday, September $6^{th}$, which is equivalent to before sunset on September $6^{th}$, or the beginning of the Sabbath according to the Jewish calendar month 10. Additionally, the day block 50*c* depicts the moon phase marking 40 to indicate the appearance of a new moon, and hence the beginning of the month of Tishrei. Furthermore, the day block 50*c* depicts the appropriate Torah reading 38 for the particular Jewish calendar day. In this instance, the Torah reading for the $1^{st}$ day of Tishrei is Rosh Hashanah.

In the preferred embodiment, the Jewish calendar month 10 functions in a right-to-left orientation, so as to comport with the direction in which Hebrew text is read. An alternate embodiment allows the Jewish calendar month 10 to function in a left-to-right orientation. To create this alternate embodiment, the interlocking notched weekday banner 14 and the interlocking notched day block arrangement 16 are flipped on their respective vertical axis. Thus, the top day portion 52 continues to identify the beginning and end of the Gregorian calendar day and the bottom day portion 54 continues to identify the beginning and end of the Jewish calendar day.

Figure 5:
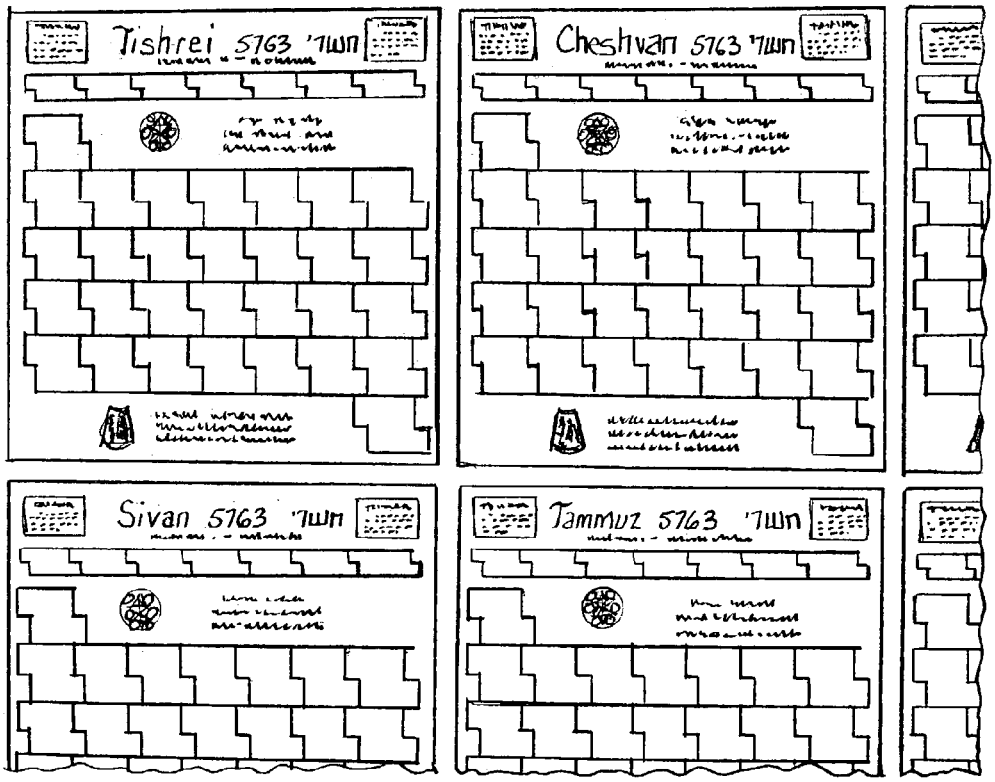
FIG. 5 shows a complete calendar comprised of a plurality of Jewish calendar months depicted in FIG. 1.

As depicted in FIG. 5, an entire Jewish calendar year can be constructed by including the appropriate number of Jewish calendar months. It is to be understood that Jewish calendar months, apart from the Jewish calendar month 10 disclosed in FIG. 1, can be created and appreciated by applying the same basic principles as have already been outlined. Additionally, other types of indicia, such as different shadings, configurations, or geometric shapes having a perimeter, can be provided so that the user can identify a corresponding Jewish calendar day and a Gregorian calendar day quickly and efficiently. Furthermore, the present invention can also be used to correspond other types of calendars with one another. Thus, visual indicia can also be used to correspond non-lunar based calendars with solarbased calendars. It is noteworthy to mention that the lunar year contains 354 days, eleven days less than the solar year. Since the Torah requires that holidays occur within particular seasons, it becomes necessary to add a thirteenth month (i.e., Adar I) seven times in nineteen years. This adjustment guarantees that Passover is celebrated in the spring and Sukkot in the fall. The current Jewish year of 5763, as disclosed in FIG. 1, is one such "leap year."

The present invention has been described with reference to the preferred embodiments. Obvious modifications, combinations, and alterations will occur to others upon reading the preceding detailed description. It is intended that the invention be construed as including all such modifications, combinations, and alterations insofar as they come within the scope of the appended claims or the equivalents thereof.

I claim:

1. A calendar, comprising a medium upon which a plurality of indicia is applied, wherein each of the indicia:

coacts with an adjacent indicia;

is visually indicative of a complete lunar day and a complete solar day; and comprises a geometric shape having a perimeter, wherein the geometric shape comprises a first portion and a second portion, the first portion identifying a solar day and the second portion identifying a lunar day, and wherein the first portion comprises a first distal end and a second distal end, the first distal end representing a beginning of the solar day and the second distal end representing an end of the solar day and the second portion comprises a third distal end and a fourth distal end, the third distal end representing a beginning of the lunar day and the fourth distal end representing an end of the lunar day and further wherein the first portion is in an offset relation to a position of the second portion, the offset relation forming an offset representing an overlap of the lunar day and the solar day between the third distal end of the second portion and the first distal end of the first portion.

2. The calendar of claim 1, wherein the first portion of one of the indicia overlaps a second portion of an adjacent indicia.

3. A calendar, comprising a medium upon which a plurality of indicia is applied, wherein each of the indicia:

coacts with an adjacent indicia;

is visually indicative of a complete lunar day and a complete solar day; and comprises a first portion and a second portion, the first portion identifying a solar day and the second portion identifying a lunar day, and wherein the first portion comprises a first distal end and a second distal end, the first distal end representing a beginning of the solar day and the second distal end representing an end of the solar day and the second portion comprises a third distal end and a fourth distal end, the third distal end representing a beginning of the lunar day and the fourth distal end representing an end of the lunar day and further wherein the first portion is in an offset relation to a position of the second portion, the offset relation forming an offset representing an overlap of the lunar day and the solar day between the third distal end of the second portion and the first distal end of the first portion.

4. The calendar of claim 3, wherein each indicia for the lunar day coacts with two indicia for the solar day.

5. The calendar of claim 3, wherein each indicia for the solar day coacts with two indicia for the lunar day.

6. The calendar of claim 3, wherein each indicia form a plurality of indicia identifying:

a respective plurality of days;

a respective one or more weeks;

a respective one or more months; or a respective one or more years.

7. The calendar of claim 3, wherein the first portion defines a rectangle and the second portion defines a rectangle.

8. The calendar of claim 3, wherein the calendar includes a plurality of months and seven indicia coact with each other to identify a week in rows and a plurality of indicia coact with each other to define days of a week.

9. The calendar of claim 3, wherein each indicia has a first end and a second end adapted to coact with indicia for a same day of the week.

10. The calendar of claim 3, wherein the plurality of indicia comprises notched block shapes adapted to mate with adjacent indicia on two sides.

11. The calendar of claim 3, wherein the calendar comprises a plurality of months.

12. The calendar of claim 9, wherein each of the indicia comprise two stepped quadrilaterals, one positioned above each other, so that a first portion of one of the two quadrilaterals is positioned on top of the other quadrilateral defining a common portion and respective portions of the quadrilaterals extending from the common portion defining two recesses for receiving an offset portion of an adjacent indicia.

13. The calendar of claim 12, wherein the quadrilaterals are rectangles.

14. The calendar of claim 13, further comprising an interlocking notched indicia weekday banner, wherein the interlocking notched indicia weekday banner represents a relation between the seven days of a Jewish week and the seven days of a secular week.

15. The calendar of claim 14, wherein the indicia is provided on print media.

16. The calendar of claim 14, wherein the indicia are provided on electronic media.

17. The calendar of claim 15, wherein the print media is paper.

* * * * *